US011154759B2

(12) United States Patent
King, II

(10) Patent No.: US 11,154,759 B2
(45) Date of Patent: Oct. 26, 2021

(54) LIGHT-UP SWORD GAME

(71) Applicant: STARLUX GAMES, LLC, Los Angeles, CA (US)

(72) Inventor: Judd Paul King, II, Los Angeles, CA (US)

(73) Assignee: STARLUX GAMES, LLC, Los Angeles, CA (US)

( * ) Notice: Subject to any disclaimer, the term of this patent is extended or adjusted under 35 U.S.C. 154(b) by 0 days.

(21) Appl. No.: 16/287,966

(22) Filed: Feb. 27, 2019

(65) Prior Publication Data

US 2019/0282873 A1 Sep. 19, 2019

Related U.S. Application Data

(60) Provisional application No. 62/642,295, filed on Mar. 13, 2018.

(51) Int. Cl.

| | |
|---|---|
| ***A63B 67/00*** | (2006.01) |
| ***A63H 33/22*** | (2006.01) |
| ***A63H 33/00*** | (2006.01) |

(52) U.S. Cl.

CPC ..... *A63B 67/00* (2013.01); *A63H 33/009* (2013.01); *A63H 33/22* (2013.01); *A63B 2225/74* (2020.08)

(58) Field of Classification Search

CPC ..... H05B 37/02; A63B 24/00; A63B 59/00; A63B 67/00; F41B 9/00

See application file for complete search history.

(56) References Cited

U.S. PATENT DOCUMENTS

| | | | | | |
|---|---|---|---|---|---|
| 5,060,956 | A * | 10/1991 | Glass | A63B 59/60 | 273/409 |
| 5,300,921 | A * | 4/1994 | Hoch | A61B 5/1121 | 340/573.6 |
| 6,004,232 | A * | 12/1999 | Sennott | A63B 67/00 | 473/415 |
| 6,354,969 | B1 * | 3/2002 | Sullivan | A63B 69/002 | 473/422 |
| 2002/0177495 | A1 * | 11/2002 | Ciesiun | G09F 3/00 | 473/415 |
| 2005/0104295 | A1 * | 5/2005 | Buckfield | A63B 67/066 | 273/317 |
| 2005/0162257 | A1 * | 7/2005 | Gonzalez | A63B 71/0605 | 340/323 R |
| 2005/0192127 | A1 * | 9/2005 | Young, Jr. | A63B 67/00 | 473/502 |
| 2007/0298913 | A1 * | 12/2007 | Winn | A63C 19/065 | 473/490 |
| 2009/0005196 | A1 * | 1/2009 | Kessler | A63B 67/002 | 473/476 |
| 2009/0042675 | A1 * | 2/2009 | Baun, II | A63B 67/00 | 473/502 |
| 2010/0151972 | A1 * | 6/2010 | Lim | A63B 57/353 | 473/406 |
| 2011/0183783 | A1 * | 7/2011 | Rahim | A63B 71/0622 | 473/422 |

(Continued)

*Primary Examiner* — Eugene L Kim
*Assistant Examiner* — Christopher Glenn
(74) *Attorney, Agent, or Firm* — Thorpe North & Western, LLP.

(57) ABSTRACT

A kit of parts for playing a tag game in low-light conditions includes first and second base markers, first and second plurality of team identifiers, and first and second plurality of batons. The base markers, team identifiers and the batons emit light.

7 Claims, 6 Drawing Sheets

(56) References Cited

U.S. PATENT DOCUMENTS

| | | | | |
|---|---|---|---|---|
| 2011/0263355 | A1* | 10/2011 | Delorme | A63B 69/0026 473/446 |
| 2013/0015203 | A1* | 1/2013 | Zuloff | F41A 33/02 222/113 |
| 2013/0029794 | A1* | 1/2013 | Kortegast | A63B 71/0036 473/570 |
| 2013/0107507 | A1* | 5/2013 | Tucker | F21V 23/0435 362/190 |
| 2013/0178312 | A1* | 7/2013 | Marks | A63B 71/06 473/415 |
| 2015/0062959 | A1* | 3/2015 | Wilson | H05B 47/19 362/570 |
| 2016/0023070 | A1* | 1/2016 | Wolfe | A63B 59/20 473/513 |
| 2016/0058335 | A1* | 3/2016 | Ashby | A61B 5/296 600/301 |
| 2016/0074708 | A1* | 3/2016 | Belhassen | A63B 24/0075 473/446 |
| 2016/0121186 | A1* | 5/2016 | Sciandra | A63B 63/00 273/350 |
| 2016/0136504 | A1* | 5/2016 | Cuttino | A63B 71/0686 473/415 |
| 2017/0363867 | A1* | 12/2017 | Poulos | G02B 27/0172 |

* cited by examiner

LIGHT-UP SWORD GAME

PRIORITY CLAIM AND RELATED APPLICATIONS

Priority is claimed to U.S. Provisional Patent Application No. 62/642,295, filed, Mar. 13, 2018, which is hereby incorporated herein by reference in its entirety.

BACKGROUND

With the prevalence of cellular phones and constant internet connectivity among youth, there is an increasing desire to motivate such youth to engage in physical activity and interact socially. Some multi-player athletic games can be played and enjoyed in well-lit conditions. However, unique issues can arise when these games are attempted in low-light conditions. There can be difficulties and inherent limitations associated with gameplay in reduced visibility conditions. Some of these issues can add to the competitive challenge of the game. Other aspects of low-light conditions may limit the typical options and strategies used during gameplay in normal lighting conditions.

BRIEF DESCRIPTION OF THE DRAWINGS

Features and advantages of the invention will be apparent from the detailed description which follows, taken in conjunction with the accompanying drawings, which together illustrate, by way of example, features of the invention; and, wherein.

Figure 1:
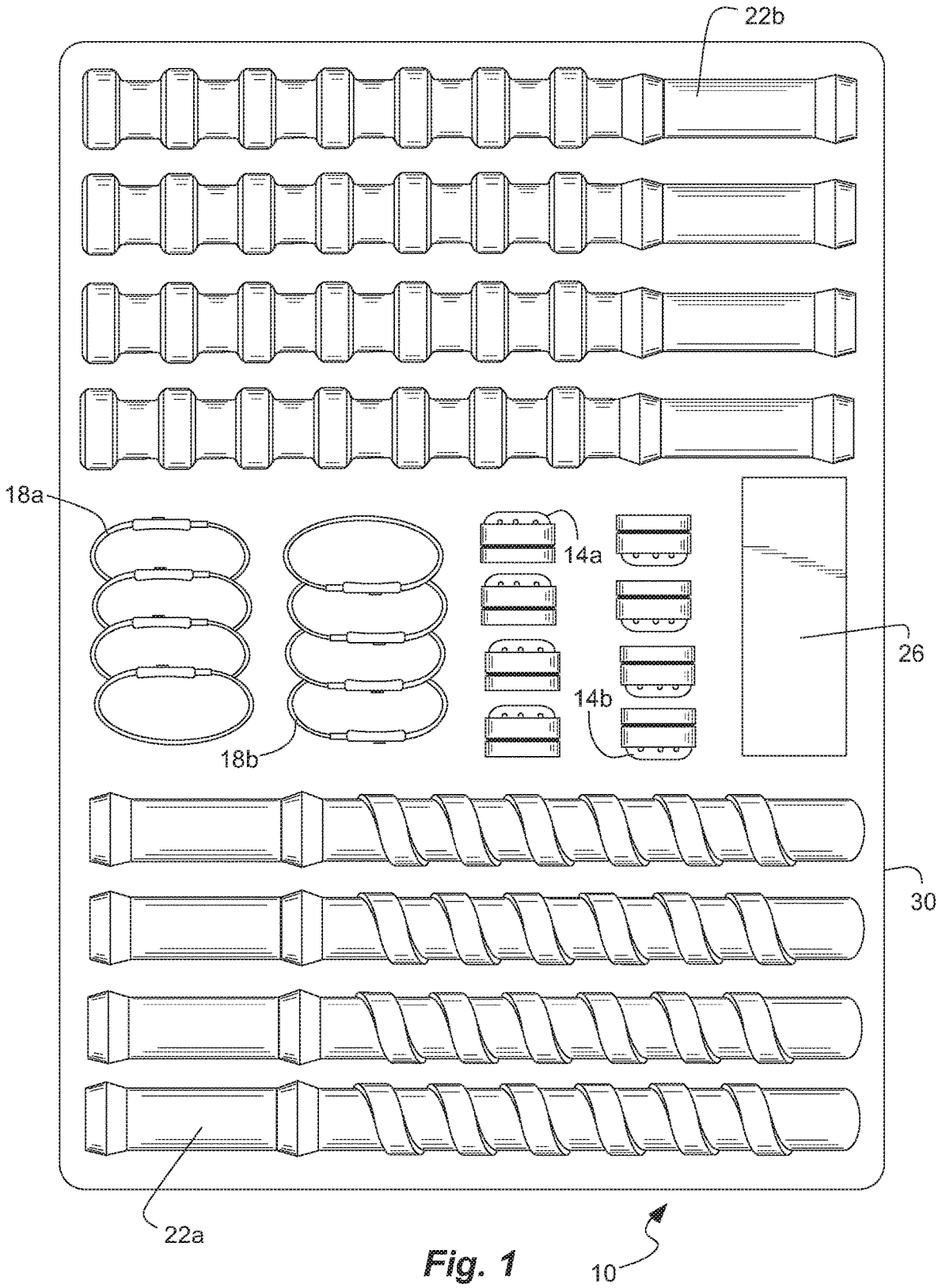
FIG. 1 is a schematic depiction of an example of a kit of parts for playing a game in low-light conditions according to the present disclosure, including base markers, team identifiers, batons and instructions.
Figure 2:
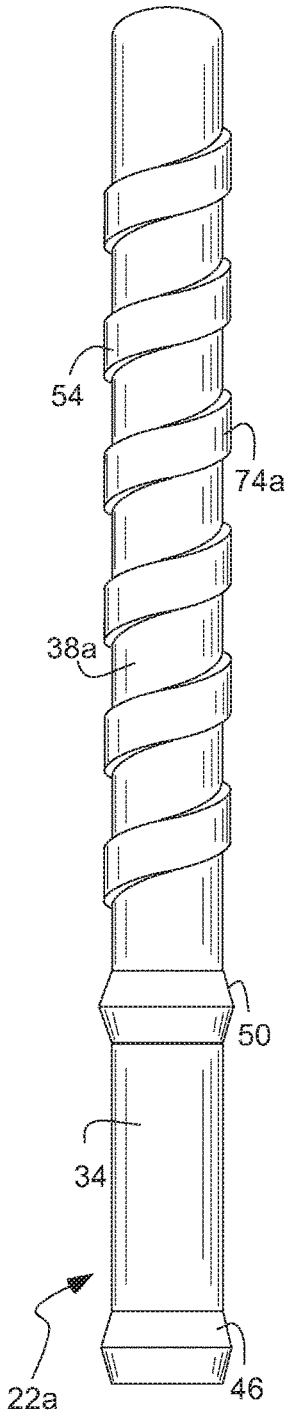
FIG. 2 is a side view of a baton of FIG. 1 according to the present disclosure.
Figure 3:
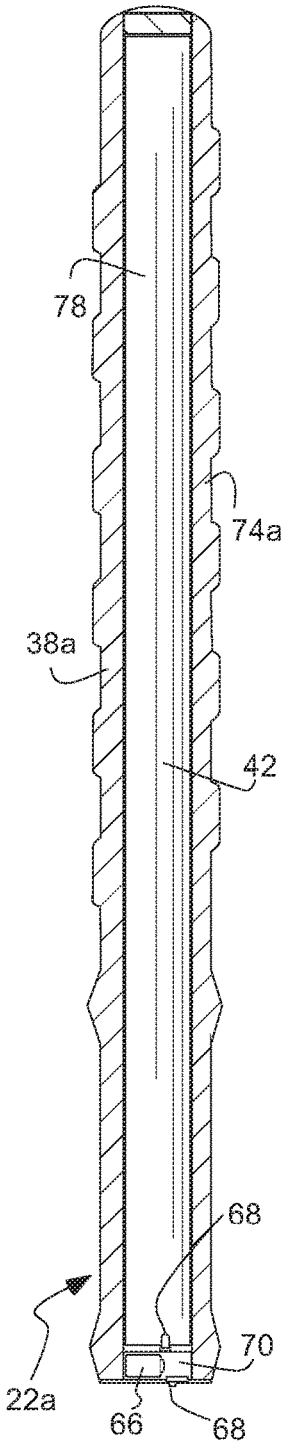
FIG. 3 is a cross-sectional side view of the baton of FIG. 2.
Figure 4:
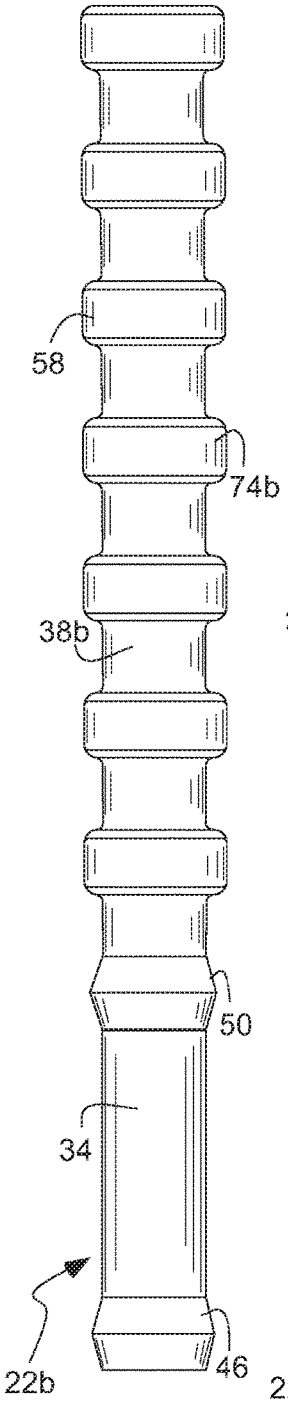
FIG. 4 is a side view of a baton of FIG. 1 according to the present disclosure.
Figure 5:
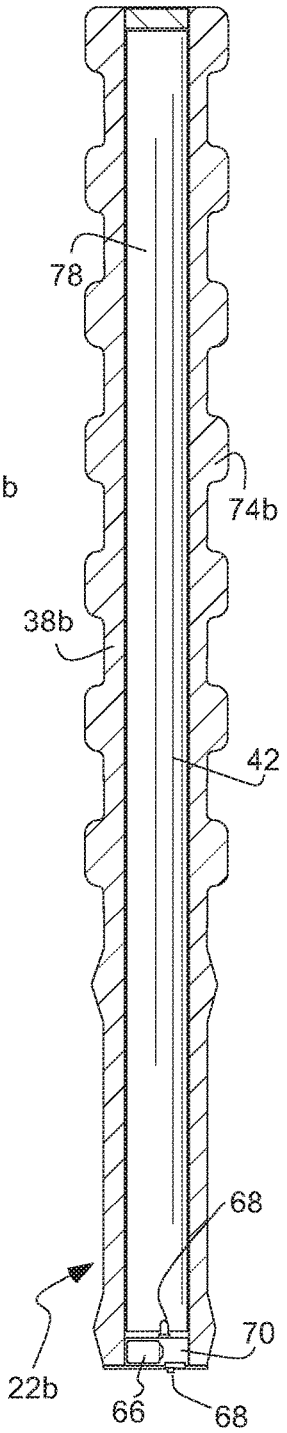
FIG. 5 is a cross-sectional side view of the baton of FIG. 4.

Reference will now be made to the exemplary embodiments illustrated, and specific language will be used herein to describe the same. It will nevertheless be understood that no limitation of the scope of the invention is thereby intended.

DETAILED DESCRIPTION

Although the following detailed description contains many specifics for the purpose of illustration, a person of ordinary skill in the art will appreciate that many variations and alterations to the following details can be made and are considered to be included herein.

Accordingly, the following embodiments are set forth without any loss of generality to, and without imposing limitations upon, any claims set forth. It is also to be understood that the terminology used herein is for the purpose of describing particular embodiments only, and is not intended to be limiting. Unless defined otherwise, all technical and scientific terms used herein have the same meaning as commonly understood by one of ordinary skill in the art to which this disclosure belongs.

In this disclosure, "comprises," "comprising," "containing" and "having" and the like can have the meaning ascribed to them in U.S. Patent law and can mean "includes," "including," and the like, and are generally interpreted to be open ended terms. The terms "consisting of" or "consists of" are closed terms, and include only the components, structures, steps, or the like specifically listed in conjunction with such terms, as well as that which is in accordance with U.S. Patent law. "Consisting essentially of" or "consists essentially of" have the meaning generally ascribed to them by U.S. Patent law. In particular, such terms are generally closed terms, with the exception of allowing inclusion of additional items, materials, components, steps, or elements, that do not materially affect the basic and novel characteristics or function of the item(s) used in connection therewith. For example, trace elements present in a composition, but not affecting the compositions nature or characteristics would be permissible if present under the "consisting essentially of" language, even though not expressly recited in a list of items following such terminology. When using an open ended term in the specification, like "comprising" or "including," it is understood that direct support should be afforded also to "consisting essentially of" language as well as "consisting of" language as if stated explicitly and vice versa.

"The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Similarly, if a method is described herein as comprising a series of steps, the order of such steps as presented herein is not necessarily the only order in which such steps may be performed, and certain of the stated steps may possibly be omitted and/or certain other steps not described herein may possibly be added to the method.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments described herein are, for example, capable of operation in other orientations than those illustrated or otherwise described herein.

As used herein, "enhanced," "improved," "performance-enhanced," "upgraded," and the like, when used in connection with the description of a device or process, refers to a characteristic of the device or process that provides measurably better form or function as compared to previously known devices or processes. This applies both to the form and function of individual components in a device or process, as well as to such devices or processes as a whole.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result.

As used herein, "adjacent" refers to the relative placement of one object with respect to another object. In some examples, objects that are described as being "adjacent" to one another may be in a side-by-side or other similar positional relationship that can include objects that are in direct contact with one another and objects that are in close proximity to one another. The exact degree of proximity may in some cases depend on the specific context.

As used herein, "coupled" refers to a relationship of connection or attachment between one item and another item, and includes relationships of either direct or indirect connection or attachment. Any number of items can be coupled, such as materials, components, structures, layers, devices, objects, etc.

As used herein, "directly coupled" refers to a relationship of physical connection or attachment between one item and another item, where the items have at least one point of direct physical contact.

As used herein, "indirectly coupled" refers to a relationship of connection or attachment between one item and another item where the items do not have a point of direct physical contact with one another. Rather, such items can be connected, attached, or joined together by an intermediate item. For example, when a first layer of material is bound or joined to a second layer of material using an intermediate layer in between the first and second layer, the first and second layers can be said to be indirectly coupled.

Reference throughout this specification to "an example" means that a particular feature, structure, or characteristic described in connection with the example is included in at least one embodiment. Thus, appearances of the phrases "in an example" in various places throughout this specification are not necessarily all referring to the same embodiment.

An initial overview of technology embodiments is provided below and then specific technology embodiments are described in further detail later. This initial summary is intended to aid readers in understanding the technology more quickly but is not intended to identify key features or essential features of the technology nor is it intended to limit the scope of the claimed subject matter.

The invention provides a game, or kit of parts for a game, and a method for playing one or more games with the kit of parts by players that can be organized into first and second teams. The parts in the kit of parts illuminate and/or emit light in low-light conditions, such as at night or at dusk when outside, or with the lights turned off or low when indoors. The kit of parts can be used, and the game can be played, in any suitable playing environment, including indoor and outdoor areas. The level of light for low-level light gameplay can include the absence of any ambient light sources or apparent total darkness. In some examples of low-level light gameplay, there may be sufficient light to see the ground and any obstacles within the field of play. Further, environments of uniform or non-uniform surfaces can be used for gameplay. For example, an indoor or outdoor athletic field can be used such as a field otherwise used for football, soccer, or the like. Also, areas such as basketball or tennis courts may be used as a playing environment. The athletic field may be partially or totally exposed to external conditions of weather and lighting. An enclosed gymnasium can be used with lighting controls to vary a level of lighting within the gymnasium as desired for the level of visibility desired for gameplay. Alternatively, other environments including natural landscapes of trees, hills and other features may be used for gameplay. Other indoor environments including various obstacles may be used as well.

The game and the kit of parts can promote physical activity and social interaction amongst the players. In one aspect, the parts or the kit of parts can comprise batons that can be elongated, illuminated and compliant. The batons can be or can represent weapons, or faux or mock weapons, such as swords, daggers, rapiers, foils, blades, sabers, spears, tritons, batons, or clubs; wands; staffs; scepters; etc. The batons can have a magical or exciting aspect because they illuminate, or at least a portion thereof illuminates. The batons are compliant so that they can be used to strike, tag or touch other players without causing injury. In another aspect, the parts or the kit of parts can comprise team and/or status identifiers (hereinafter team identifiers) that can be worn or donned, and that can be illuminated. The team identifiers can be or can represent jewelry, such as bracelets, talismans, amulets, charms, broach, embellishments, or necklaces; apparel, such as belts or vests; etc. The team identifiers can be donned or otherwise affixed to the players or the players' clothing. The team identifiers can have a magical or exciting aspect because they illuminate. The team identifiers can also indicate a status of the player with different visual indications (e.g. constant light and strobe light). In another aspect, the parts or the kit of parts can comprise base markers, or regeneration stations, that can be disposed on the ground and illuminated.

The parts can illuminate or emit a chosen color, and in particular first and second different colors corresponding to and associated with the first and second teams. Thus, the base marker, team identifiers, and batons of the first team can emit the first color, while the base marker, team identifiers, and batons of the second team can emit the second color to distinguish the players of the second team from the players of the first team. Various games can be played with the kit of parts, including for example, tag, battle, capture the flag, capture the flag with a defender variation, death race, gladiators, gladiators with a steal the bacon version, gladiators with wound variation, king of the hill, round robin, two-round elimination, kings and queens, thieves and guards, vampires, etc. The players can also use the kit of parts to create new games.

Referring to FIG. 1, the invention can provide a kit of parts 10 in one exemplary implementation. The kit of parts 10 can comprise at least one first base marker 14*a*, first team identifiers 18*a*, and first batons 22*a* for a first team, and at least one first base marker 14*b*, first team identifiers 18*b*, and first batons 22*b* for a second team. The base markers 14*a* and 14*b*, the team identifiers 18*a* and 18*b*, and the batons 22*a* and 22*b* can emit light of first and second colors, respectfully, associated with the first and second teams. Thus, each team is identified by and visually distinguishable by a different color. In addition, the light emitting parts can allow games to be played in low-light conditions, such as indoors with the lights off, or outside at night or at dusk. Furthermore, the light emitting parts can provide a sense of magic to the game. The kit of parts 10 can also comprise instructions 26 for playing the game(s). The kit of parts 10 can also comprise a case 30 for containing the parts when not in use.

Referring to FIGS. 2-5, the kit of parts 10 can comprise a first plurality of light emitting, elongated first batons 22*a*, and a second plurality of light emitting, elongated second batons 22*b*. The batons 22*a* and 22*b* can be grasped and wielded by the players, and used to tag or strike other players. The first batons 22*a* can be associated with and carryable by players of the first team, and can provide the first color, while the second batons 22*b* can be associated with and carryable by players of the second team, and can provide the second color. In one aspect, the first and second batons 22*a* and 22*b* can emit light of the first and second colors, respectively. In another aspect, the first and second batons 22*a* and 22*b* can be colored the first and second colors, respectively. Thus, the first and second batons 22*a* and 22*b* can be visually distinguished from one another by their color and/or the color they emit. In addition, the first and second batons 22*a* and 22*b* can have different shapes and designs. In one aspect, the first baton 22*a* can have a helix while the second baton 22*b* can have a series of rings. Thus, the first and second batons 22*a* and 22*b* can be visually distinguished from one another by their shape and design.

In one aspect, each of the batons 22*a* and 22*b* can be elongated, light emitting, and compliant, flexible or soft. The elongated batons 22*a* and 22*b* can have a handle 34 at a proximal end and a compliant shank 38*a* and 38*b*, respectively, extending therefrom to a distal end. At least the shank 38*a* and 38*b* of the batons 22*a* and 22*b* can be sufficiently flexible and/or compliant so that the baton 22*a* or 22*b* is capable of striking a human body under human force without injury to the human body. In one aspect, at least the shanks 38*a* and 38*b* can comprise foam. In another aspect, a flexible joint or flexure can be formed between the handle and the shank. In another aspect, the shank can be sized and shaped to induce compliance. In another aspect, the shank 38*a* and 38*b* can be formed as a cylinder with a bore or hollow 42 therethrough to induce compliance or deformation in the shank.

In another aspect, each baton 22*a* and 22*b* can be shaped with portions of different lateral width or diameter. For example, the baton 22*a* and 22*b*, or the handle 34 thereof, can have a pommel 46 at a proximal end, or a guard 50 between the handle 34 and the shank 38*a* or 38*b*, or both. The pommel 46 and the guard 50 can have a lateral dimension or diameter greater than a lateral dimension or diameter of the handle 34, or a portion of the handle 34 between the pommel 46 and the guard 50. In another aspect, the shanks 38*a* and 38*b* can have a different size, shape and/or design than the handle 34, and each other. In one aspect, the shank 38*a* of the first baton 22*a* can have a first shape, e.g. a helix 54 formed around the shank 38*a*, or cylinder thereof, and extending from near the guard 50 to near the distal end. Similarly, the shank 38*b* of the second baton 22*b* can have a different second shape, e.g. a series of spaced-apart rings 58 extending around the shank 38*b*, and extending from near the guard 50 to near the distal end. Thus, the first and second batons 22*a* and 22*b* can be visually distinguishable from one another by their shapes. The first shape can be associated with the first team, while the second shape can be associated with the second team. In another aspect, the first and second batons 22*a* and 22*b* can have first and second different colors. For example, the batons 22*a* and 22*b* can be molded from first and second colored foam. As another example the batons 22*a* and 22*b* can have a paint or ink applied to the external surfaces thereof that have the first and second colors.

Each baton 22*a* and 22*b* can comprise a light source 62 (e.g. LED) and a power source 66 (e.g. battery) and a switch 68. The light source 62 and the battery 66 can be disposed in a housing 70 defining a light unit that is separate and discrete with respect to the baton 22*a* or 22*b*. At least a portion of the shank 38*a* and 38*b* and/or the handle 34 can be at least light translucent, and capable of being illuminated by the light source 62. For example, the baton 22*a* or 22*b* can have an elongated body 74*a* or 74*b* forming the handle 50 and the shank 38*a* or 38*b*. In one aspect, the body 74*a* or 74*b* can comprise closed-cell foam or a core of closed-cell foam. The closed-cell foam can be at least light translucent. The light source 62 can illuminate the closed-cell foam of the body 74*a* and 74*b*, and cause the shanks 38*a* and 38*b* to emit light. The light source 62 and the battery 66, and the light unit, can be carried by the body 74*a* and 74*b*. The housing 70 with the light source 62, or the light unit, can be positioned at one end of the baton 22*a* and 22*b*. In one aspect, the housing 70 with the light source, or the light unit, can be located in a recess or a cavity formed in the proximal end of the baton 22*a* and 22*b*, and in the pommel 46 of the handle 34. In another aspect, body 74*a* or 74*b* can have an elongated bore or hollow 42 extending from the light source 62 and the recess substantially therethrough, or between the proximal and distal ends. One end of the hollow 42 can be closed by the light unit while the opposite end can be closed by a plug. Thus, light from the light source can emit through the hollow 42 to better illuminate the shanks 38*a* and 38*b*. In another aspect, an inner sheath 78 of at least translucent material can extend through the hollow 42 to aid in reflecting light the length of the hollow 42. The inner sheath 78 can be a sheet of transparent film rolled into a cylinder and inserted into the hollow 42. The hollow 42 and the inner sheath can aid in distributing light along the length of the batons 22*a* and 22*b* or shanks 38*a* and 38*b* thereof. In addition, the hollow 42 can reduce a wall thickness of the shanks 38*a* and 38*b*, or the bodies 74*a* and 74*b*, the increase light transmittance therethrough. In one aspect, the helix 54 and the rings 58 of the shanks 38*a* and 38*b*, respectively, can increase the wall thickness, varying the light transmittance and creating shadow patterns on the shanks 38*a* and 38*b*.

In another aspect, an exterior surface of the batons 22*a* and 22*b*, and the shanks 38*a* and 38*b* thereof, can have indicia thereon, such as patterned ink or printing. In another aspect, the batons 22*a* and 22*b* or the bodies 74*a* and 74*b* can be solid or substantially solid. The bodies 74*a* and 74*b* can be formed by an extruded closed-cell foam core that is compliant, flexible and/or soft.

In another aspect, the batons 22*a* and 22*b*, and the bodies 74*a* and 74*b* and the shanks 38*a* and 38*b*, can have a blunt cross-section (perpendicular to a longitudinal axis of the baton). In one aspect, the cross-section can be substantially circular, oval or oblong, or polygonal with rounded corners. In another aspect, the distal end can be semi-spherical. Thus, the batons 22*a* and 22*b* can be shaped to avoid injury.

To provide light of a desired color, the light source 62 itself can be the desired color (i.e. a colored LED), the light source 62 can have a colored filter or cap of the desired color disposed thereabout, or the body 74*a* and 74*b* or the foam core can be light translucent and can have the desired color.

Figure 6:
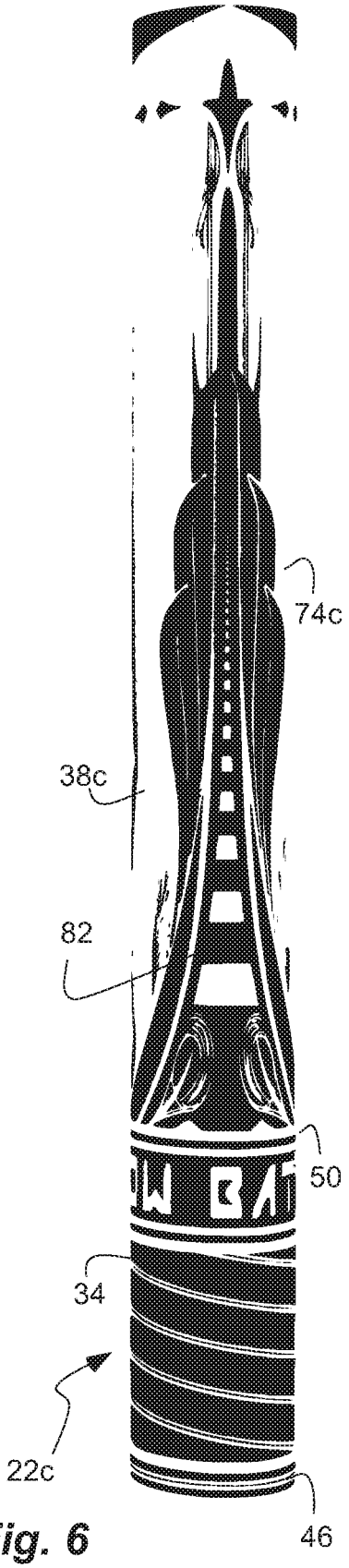
FIG. 6 is a side view of another baton according to the present disclosure.
Figure 7:
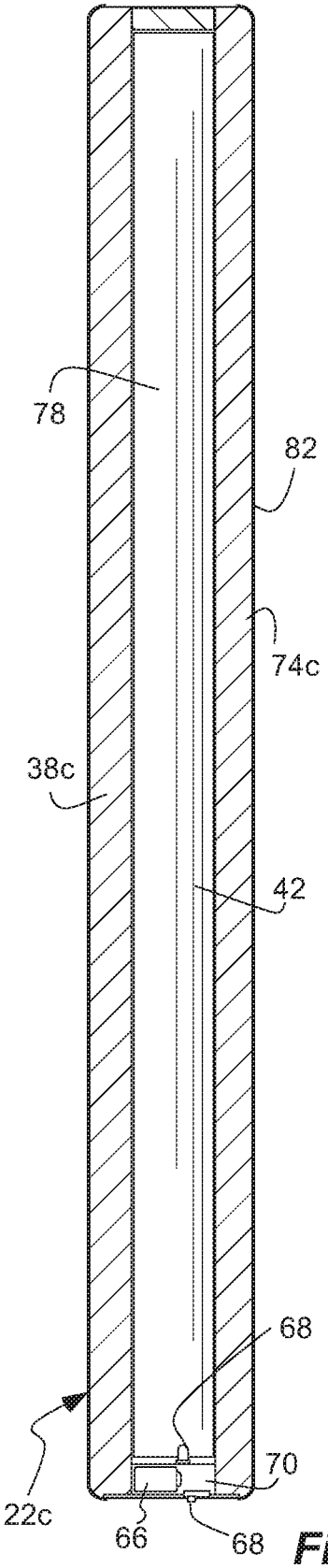
FIG. 7 is a cross-sectional side view of the baton of FIG. 6.
Figure 8:
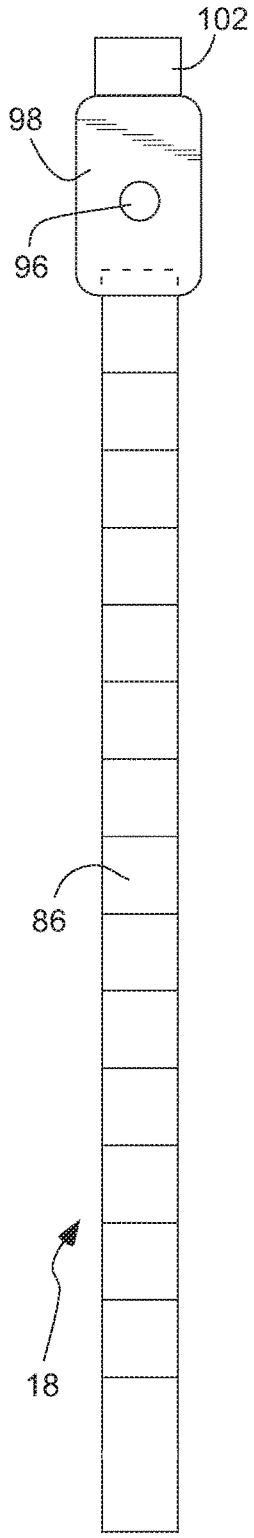
FIG. 8 is a top view of a team identifier of FIG. 1 according to the present disclosure.
Figure 9:
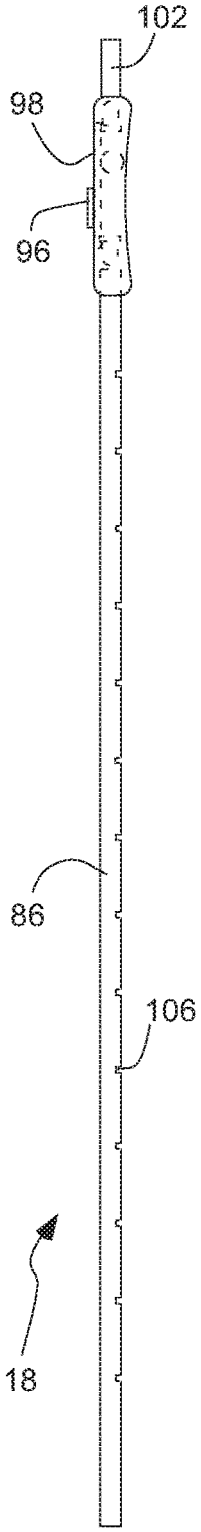
FIG. 9 is a side view of the team identifier of FIG. 8.
Figure 10:
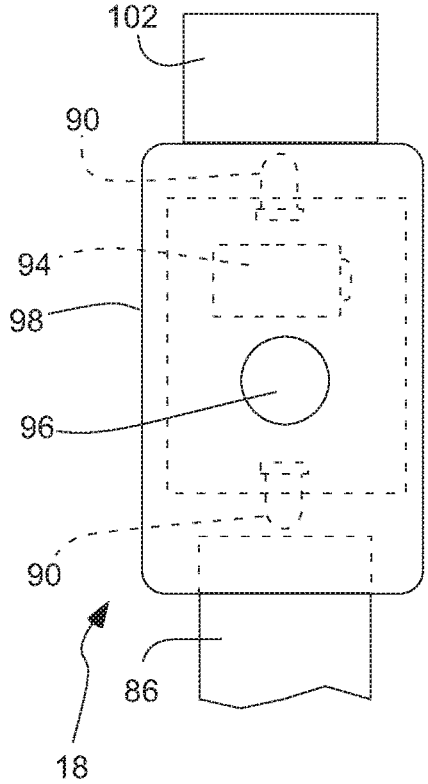
FIG. 10 is a detailed partial top view of the team identifier of FIG. 8.
Figure 11:
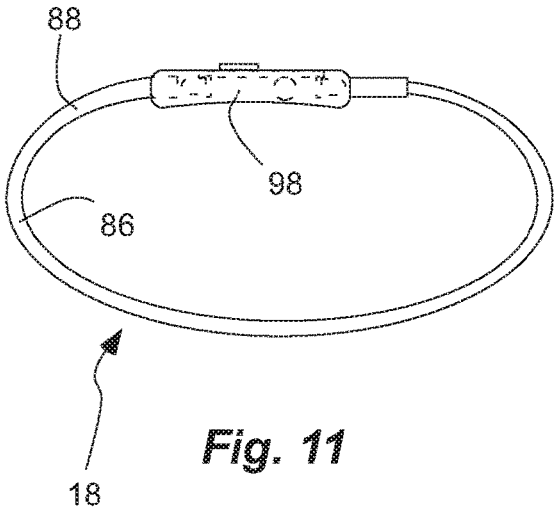
FIG. 11 is a side view of the team identifier of FIG. 8.

Referring to FIGS. 6 and 7, another baton 22*c* is shown that is similar in many respects to those described above, and which description is hereby incorporated herein by reference. The baton 22*c*, or the body 74*c* or the foam core, can further have a skin 82 disposed thereon, or disposed over the body 74*c* or the foam core. The skin 82 can form an outer sheath. In one aspect, the skin 8 can completely or substantially surround the body 74*c* or the baton 22*c*. For example, the skin 82 can surround a lateral perimeter or circumference of the body 74*c* along the entire length thereof, and even a perimeter of the distal and proximal ends thereof. Thus, the skin 82 can help maintain the light unit attached to the body 74*c*. The skin 82 can be formed as a cylinder or elongated bag (i.e. a precursor that can be flexible, enlarged, and/or flat) that can be shrink wrapped on the body 74*c* or the foam core by the application of heat thereto. In another aspect, the skin 82 can comprise indicia thereon. For example, the indicia can be printed on the skin 82 or the precursor thereof. The indicia, and thus the skin 82, can have opaque (or relatively opaque or less translucent) portions, and light emitting portions (or relatively translucent or transparent or more translucent) capable of transmitting light from the light source 62 therethrough. The indicia or opaque portions thereof can visually distinguish or define different portions of the baton 22*c*, such as the handle 34 and the shank 38*c*. In addition, the indicia or the opaque portions thereof can mimic characteristics of a desired baton, such as representing a sword or a wand. Thus, the baton 22*c* can have a substantially cylindrical shape, while the indicia of the skin 82 imparts form and design thereto. In another aspect, the skin 82, or the indicia or light emitting portions thereof, can have the desired color.

In another aspect, the baton can comprise an inflatable bladder. The bladder can be elongated and can have selectively openable and closable value to allow the bladder to be inflated. The light unit can be disposed in the bladder or can be carried by the bladder, of can form a portion of the bladder. In another aspect, the baton, or the exterior surface or the skin, may include a fluorescent material.

Referring to FIGS. 8-11, the kit of parts 10 can comprise team identifiers, represented by 18. The team identifiers 18 can be used to distinguish the players of different teams from one another, and/or to indicate a status (or mode) of a player. The team identifiers 18 can comprise a first plurality of light emitting team identifiers 18*a* (FIG. 1) providing light of the first color to identify team affiliation for the players on the first team, and a second plurality of light emitting team identifiers 18*b* (FIG. 1) providing light of the second color to identify team affiliation for players on the second team. In one aspect, the team identifiers 18 carried by the players' bodies or the players' clothing. In another aspect, the team identifiers 18 can be an apparel and can be wearable and/or donnable.

In one aspect, the team identifiers 18 can comprise a bracelet. The bracelet can comprise a strap 86 that can be formed into an annular body 88 (FIG. 11), a light source 90 (e.g. LED) and a battery 94 and a button or switch 96 carried by the strap 86 and the annular body 88. For example, the light source 90 and the battery 94 can be disposed in a housing 98 coupled to the strap 86. The ends of the strap 86 can be fastened to the housing 98 to form the annular body 88. One end of the strap 86 can be fixed to the housing 98, while the opposite end of the strap 86 can be removably secured to a fastener, such as a collar 102, on an opposite end of the housing 98. In one aspect, at least a portion of the annular body 88 can be at least translucent and capable of being illuminated by the light source 90. For example, the strap 86 and the annular body 88 can be solid or substantially solid and formed of a translucent material such that light from the light source 90 passes through and out of the strap 86 and the annular body 88, and causes the strap 86 and the annular body 88 to illuminate. In one aspect, the strap 86 can comprise a translucent and flexible plastic. Thus, the strap 86 and the annular body 88 can provide a continuous arc of light. In another aspect, the strap 86 can have an array of transverse slits 106 to help diffract light. In one aspect, the light source 90 can comprise a pair of light sources, such as LEDs, disposed at the opposite ends of the strap 86, and oriented to direct light into the ends of the strap 86. To provide light of a desired color, the light source 90 itself can be the desired color (i.e. a colored LED), the light source 90 can have a colored filter or cap of the desired color disposed thereabout, or the strap 86 and the annular body 88 can be light translucent and can have the desired color. In another aspect, the strap 86 and the annular body 88 can be formed of material that is translucent or transparent, and can have inclusions or discontinuities therein and arrayed along its length which receive and reflect the light from the light source 90. Thus, the strap 86 and the annular body 88 can provide numerous discrete and separate light sources.

In another aspect, the team identifiers 18 and/or the bracelets can further have a button or switch 96 operatively coupled to the light source 90 and the battery 94, and can be operable to control operation of the light source 90 between at least two modes of operation, including: an initial mode with an initial illumination (e.g. constant), and a subsequent mode with a subsequent illumination (e.g. strobe) different from the initial illumination. Each mode of operation can be visually distinct (e.g. constant and strobe) to indicate a status of an associated player.

In another aspect, the annular body can be segmented with opposite ends overlapping one another at an overlap. A clasp (e.g. buckle with a finger disposable in an array of holes; a cam type buckle to compression clasp one end; a friction type buckle to receive the end around a column and double back over itself; magnets, etc.) can be coupled to the annular body and can releasably couple the opposite ends at the overlap so that the annular body has at least two fixed circumferences. In another aspect, the bracelet or the annular body may include a fluorescent material.

Figure 12:
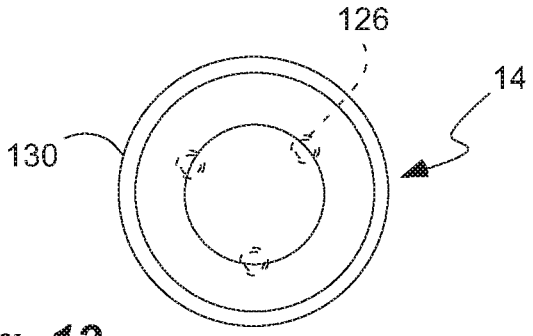
FIG. 12 is a top view of a base marker of FIG. 1 according to the present disclosure.
Figure 13:
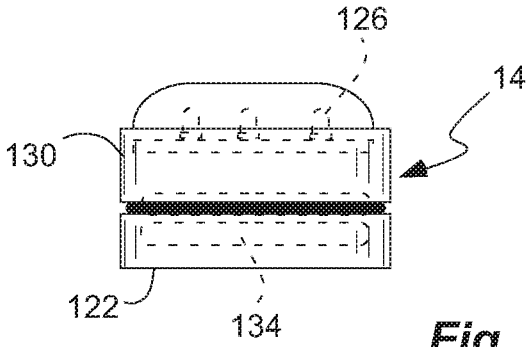
FIG. 13 is a side view of the base marker of FIG. 12.
Figure 14:
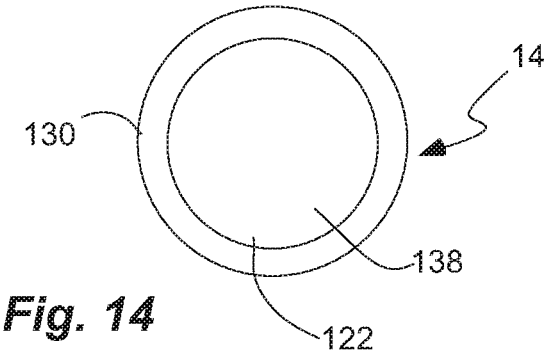
FIG. 14 is a bottom view of the base marker of FIG. 12.
Figure 15:
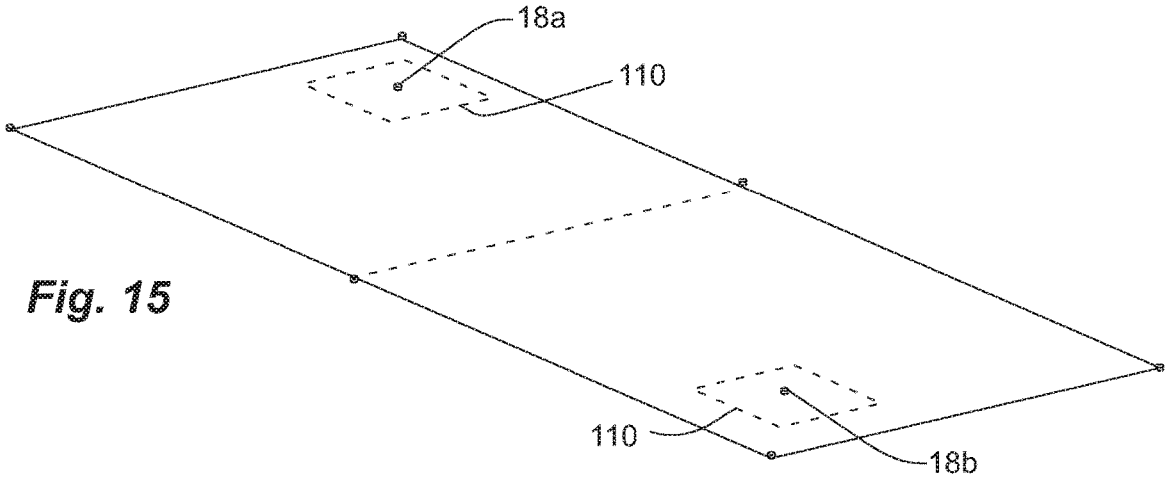
FIG. 15 is a schematic perspective view of a field of play with base markers thereon according to the present disclosure.

Referring to FIGS. 12-14, the kit of parts 10 can comprise base markers, referred to by 14. The base markers 14 can be used to establish a home base, regeneration station, or respawn location. The base markers 14 can comprise at least one light emitting first base marker 14*a* (FIG. 1) providing light of the first color assigned to the first team, and at least one light emitting second base marker 14*b* (FIG. 1) providing light of the second color assigned to the second team. In one aspect, each of the first and second base markers 18*a* and 18*b* can each comprise a single marker, each used to designate a general area 110 surrounding the base marker, as shown in FIG. 15. In another aspect, each of the first and second markers 18*a* and 18*b* can each comprise multiple markers (e.g. three or four markers) that can be deployed in a polygon (e.g. a triangle 114 in FIG. 16, a square or rectangle 118 in FIG. 17) and sized to receive one or more players therein. Thus, the multiple markers 18 can define a base, a station, a regeneration station, a respawn location, etc.

The base markers 18 can have a bottom or bottom surface 122 that can be disposed on a support surface, such as the ground. In an example, the base markers 18 may be placed upon a terrain by placing the base marker on a chair or floor in an open gymnasium or on the ground or a bench in an outdoor playing environment. The base markers 18 may be placed in any suitable position, including on the ground surface, for example on grass, dirt or pavement. In one aspect, the base markers 18 can have a flat bottom 122, such a flat bottom of a housing. In one aspect, the base markers 18 can provide light by illumination from a light source 126, such as a light emitting diode (LED). The base markers 18 can have a housing 130 that is at least light translucent with the light source 126 and a power source 134 (e.g. a battery) therein. In one aspect, the housing 130 can have two parts that are threaded together such that turning the two parts of the housing 130 with respect to one another selectively turns the light source 126 off and on. To provide light of a desired color, the light source 126 itself can be the desired color (i.e. a colored LED), the light source 126 can have a colored filter or cap of the desired color disposed thereabout, or the housing 130 can be light translucent and can have the desired color. In one aspect, the housing 130 can be transparent, or can have a transparent portion, and can have indicia 138 therein or carried thereby indicative of the color of the base marker 18 or the light source 126 therein. In one aspect, the base markers 14*a* and 14*b*, and light source 126 thereof, can pulse. In another aspect, the housing may include a fluorescent material.

The light sources described herein can be one or more light emitting diodes (LEDs) operable to provide a visual signal. The LEDs as used herein can be any type of LED, including organic LEDs (OLEDs), bioluminescent lights, and other low-power consuming light sources. The LEDs can be selectively actuated by a player.

Referring again to FIG. 1, the kit of parts 10 can also comprising instructions 26 for instructing players how to play at least one game with the first and second base markers 14*a* and 14*b*, the first and second plurality of team identifiers 18*a* and 18*b*, and the first and second plurality of batons 22*a* and 22*b*. The instructions 26 can comprise indicia, such as words and/or pictures. In one aspect, the instructions 26 can be disposed in the case 30 along with the other parts. In another aspect, the instructions 26 can be disposed on the case 30.

In one aspect, the instructions 26 can comprise a tag or a battle game. For example, the instructions 26 can instruct the players to:

- divide into the first and second teams;
- assign the first and second colors to the first and second teams, respectively;
- deploy the first and second base markers 14*a* and 14*b* on the support surface, and cause the first and second base markers 14*a* and 14*b* to emit light of the first and second colors, respectively;
- don the first and second plurality of team identifiers 18*a* and 18*b*, respectively, and cause the first and second plurality of team identifiers 18*a* and 18*b* to emit light of the first and second colors, respectively;
- bear the first and second plurality of batons 22*a* and 22*b*, respectively, and cause the first and second plurality of batons 22*a* and 22*b* to emit light of the first and second colors, respectively; and
- wield the first and second plurality of batons 22*a* and 22*b*, respectively, to strike the players of another team while avoiding being struck by a baton 22*a* or 22*b* of another team.

In addition, the instructions 26 can further instruct the players to:

- return to the first or second base marker 14*a* and 14*b* of their team when they are struck by the baton 22*a* or 22*b* of another team;
- return to play after being struck by a baton of another team and returning to the first or second base marker 14*a* and 14*b* of their team; and
- cease play when struck by the baton 22*a* or 22*b* of another team after a predetermined number of times.

In addition, the instructions 26 can further instruct the players to:

- change a mode of the of a team identifier 18*a* or 18*b* when they are struck by the baton 22*a* or 22*b* of another team; and/or
- return to play after being struck by a baton 22*a* or 22*b* of another team and returning to the first or second base marker 14*a* or 14*b* of their team and changing the mode of the team identifier 18*a* or 18*b*.

In addition, the instructions 26 can further instruct the players to obtain low light conditions. For example, low light condition can be obtained by turning off one or more lights in an indoor environment. As another example, low light conditions can be obtained outdoors by waiting until dusk or sundown.

In addition, a method for establishing game play, such as a tag or a battle game, with the kit of parts 10 described above, can comprise:

- instructing the players to divide into the first and second teams;
- instructing the players of the first and second teams to assign the first and second colors to the first and second teams, respectively;
- instructing the players to deploy the first and second base markers 14*a* and 14*b* on the support surface, and to cause the first and second base markers 14*a* and 14*b* to emit light of the first and second colors, respectively;
- instructing the players of the first and second teams to don the first and second plurality of team identifiers 18*a* and 18*b*, respectively, and to cause the first and second plurality of team identifiers 18*a* and 18*b* to emit light of the first and second colors, respectively;
- instructing the players of the first and second teams to bear the first and second plurality of batons 22*a* and 22*b*, respectively, and to cause the first and second plurality of batons 22*a* and 22*b* to emit light of the first and second colors, respectively;
- instructing the players of the first and second teams to wield the first and second plurality of batons 22*a* and 22*b*, respectively, to strike the players of another team while avoiding being struck by a baton 22*a* or 22*b* of another team;
- instructing the players to return to the first or second base marker 14*a* or 14*b* of their team when they are struck by the baton 22*a* or 22*b* of another team; and
- instructing the players to return to play after being struck by a baton 22*a* or 22*b* of another team and returning to the first or second base marker 14*a* or 14*b* of their team.

In addition, the method can further comprise instructing players to cease play when struck by the baton 22*a* or 22*b* of another team after a predetermined number of times.

In addition, the method can comprise:

- instructing the players to change a mode of the of a team identifier 18*a* or 18*b* when they are struck by the baton 22*a* or 22*b* of another team; and/or
- instructing the players to return to play after being struck by a baton 22*a* or 22*b* of another team and returning to the first or second base marker 14*a* or 14*b* of their team and changing the mode of the team identifier 18*a* or 18*b*.

Furthermore, a method for playing a game, such as a tag or a battle game, utilizing the kit of parts 10 described above can comprise:

dividing into the first and second teams;

assigning the first and second colors to the first and second teams, respectively;

deploying the first and second base markers 14*a* and 14*b* on the support surface, and causing the first and second base markers 14*a* and 14*b* to emit light of the first and second colors, respectively;

donning the first and second plurality of team identifiers 18*a* and 18*b*, respectively, and causing the first and second plurality of team identifiers 18*a* and 18*b* to emit light of the first and second colors, respectively;

bearing the first and second plurality of batons 22*a* and 22*b*, respectively, and causing the first and second plurality of batons 22*a* and 22*b* to emit light of the first and second colors, respectively;

wielding the first and second plurality of batons 22*a* and 22*b*, respectively, to strike the players of another team and avoiding being struck by a baton 22*a* or 22*b* of another team;

returning to the first or second base marker 14*a* or 14*b* of an assigned team when struck by the baton 22*a* or 22*b* of another team; and returning to play after being struck by a baton 22*a* or 22*b* of another team and returning to the first or second base marker 14*a* or 14*b* of the assigned team.

In addition, the method can comprise ceasing play when struck by the baton 22*a* or 22*b* of another team after a predetermined number of times.

In addition, the method can comprise:

changing a mode of the of a team identifier when struck by the baton 22*a* or 22*b* of another team; and/or returning to play after being struck by a baton 22*a* or 22*b* of another team and returning to the first or second base marker 14*a* or 14*b* of the assigned team and changing the mode of the team identifier 18*a* or 18*b*.

A method for playing a game, such as the tag or the battle game, can comprise:

providing first and second light emitting base markers 14*a* and 14*b*, each having a bottom surface configured to be disposed on a support surface, and each capable of providing light of first or second color, respectively;

providing first and second pluralities of light emitting team identifiers 18*a* and 18*b*, each comprising an apparel wearable by players, and each capable of providing light of the first or second color, respectively;

providing first and second pluralities of light emitting, elongated batons 22*a* and 22*b* carryable by players, each comprising a handle 50 and a compliant shank 38*a* and 38*b*, and each capable of providing light of the first or second color respectively;

dividing the players into first and second teams;

assign the first and second colors to the first and second teams, respectively, the first color being associated with the first base marker 14*a*, the first plurality of team identifiers 18*a* and the first plurality of batons 22*a*, and the second color being associated with the second base marker 14*b*, the second plurality of team identifiers 18*b* and the second plurality of batons 22*b;* deploy the first and second base markers 14*a* and 14*b* on the support surface, and causing the first and second base markers 14*a* and 14*b* to emit light of the first and second colors, respectively;

donning the first and second plurality of team identifiers 18*a* and 18*b*, respectively, and causing the first and second plurality of team identifiers 18*a* and 18*b* to emit light of the first and second colors, respectively;

bearing the first and second plurality of batons 22*a* and 22*b*, respectively, and causing the first and second plurality of batons 22*a* and 22*b* to emit light of the first and second colors, respectively; and wielding the first and second plurality of batons 22*a* and 22*b* to strike a player of another team while avoiding being struck by a baton 22*a* or 22*b* of another team.

In addition, the method can comprise:

returning to the first or second base marker 14*a* or 14*b* when struck by the baton 22*a* or 22*b* of another team;

returning to play after being struck by a baton 22*a* or 22*b* of another team and returning to the first or second base marker 14*a* or 14*b* of their team; and/or ceasing play when struck by the baton 22*a* or 22*b* of another team after a predetermined number of times.

Furthermore, the method can comprise:

changing a mode of the of a team identifier 18*a* or 18*b* when struck by the baton 22*a* or 22*b* of another team; and/or returning to play after being struck by a baton 22*a* or 22*b* of another team and returning to the first or second base marker 14*a* or 14*b* of their team and changing the mode of the team identifier 18*a* or 18*b*.

Variations different games can be played with the kit of parts 10 as described above. The games may be variations of that described above. And the instructions 26 can include variations. Below are examples of other games that can be played.

Capture the Flag

Figure 16:
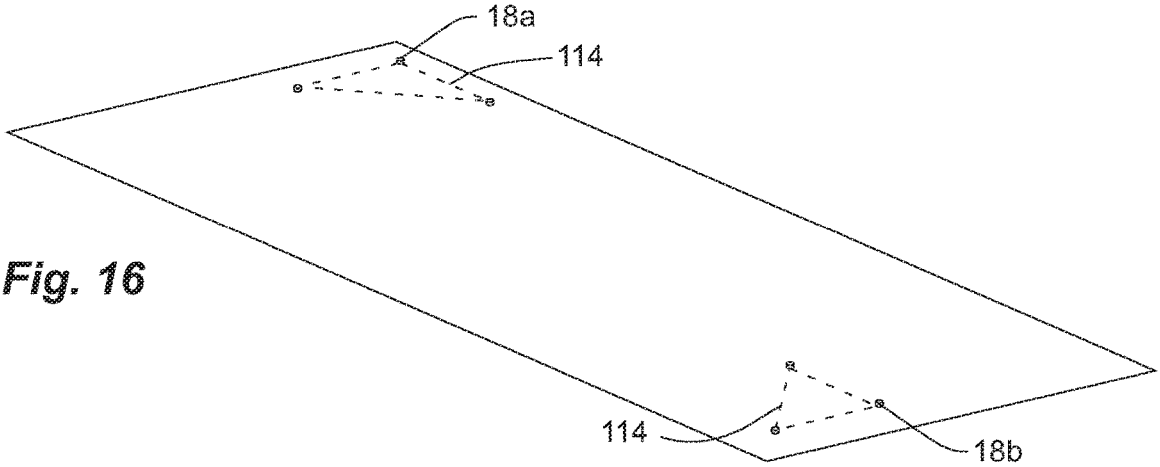
FIG. 16 is a schematic perspective view of another field of play with base markers thereon according to the present disclosure.
Figure 17:
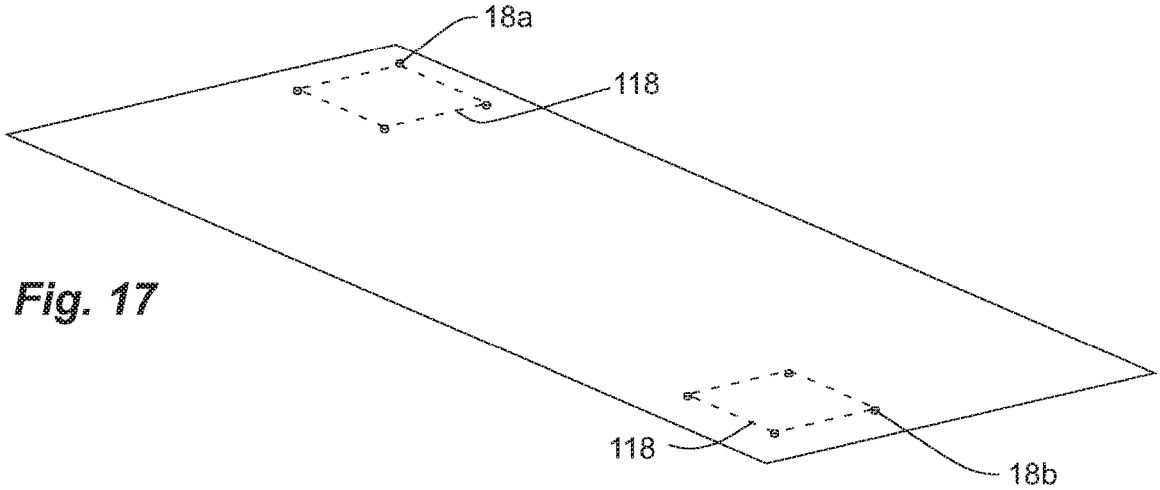
FIG. 17 is a schematic perspective view of another field of play with base markers thereon according to the present disclosure.

Capturing your rightful Station Light or one of the base markers 14*a* or 14*b* (i.e. flag) is the goal. You must capture your first team's symbolic flag (one of your Station Lights or base markers 14*a* or 14*b*). The Regeneration Station will use just three station lights or base markers 14*a* or 14*b* to form a triangle (FIG. 16). The enemy or opposing or second team places your station light or base marker 14*a* on their territory to begin the game (it can be 15 ft away from their own Regen Station or base marker 14*b*). You try to get your first team's Station Light or base marker 14*a* back to your Regen Station or base marker 14*a*. In one aspect, passing the light or base marker 14*a* is not allowed. If you get blindsided with a foam sword or baton 22*b* hit, you have to drop the light or base marker 14*a* . . . immediately! It may take several tries, and player hits, to get your station light or base marker 14*a* all the way back to your Station or base marker 14*a*! You can't get closer than 15 ft to the other team's Station light or base marker 14*b* until they pick it up.

Capture the Flag—Defender Variation

This differs from the above version of Capture the Flag in a couple ways in that: it takes three hits to knock your opponent out of the game; the Territory Lights (or base markers 14*a* or 14*b* or other markers) are used to divide the field in half (FIG. 15) instead of marking the corner boundaries; and each team has Scouts (no weapon) and Defenders (have Weapons of Light or batons 22*a* or 22*b* to defend against the other Team's Scouts).

The Scouts from each team try to get past the opposing Defenders and take their Regen Light or base marker 14*a* or 14*b* back to their own Station or base maker 14*a* or 14*b*. Defenders can only defend, so they are not allowed to cross over the dividing lights or base markers 14*a* or 14*b* (FIG. 15)

of the field. Lose all your Scouts and your team is done. Snatch your Regen Light or base marker 14*a* or 14*b* from the enemy and drop it on your own territory and the other team loses! Lots of tactics to consider here!

Death Race

This game can end fast! It depends on how much guts your team has. Are you all gonna run wild to catch the enemy off guard or play it safe? The goal is to run past the other team's Regen Station or base marker 14*a* or 14*b*, without feeling the "deadly" slice of foam or baton 22*a* or 22*b* on your skin. Make it past and earn your team one point. The team with the most points at the end of the time limit is the winner. Once you earn a point, you can earn no more. So sit out and wait for the rest of the chaos to wrap up!

Gladiators

Get the picture . . . . You stand across the field of battle, sweat dripping onto your now legendary Weapon of Light or baton 22*a* or 22*b*. In a few seconds, you will run toward (after a countdown—3-2-1 GO!) your sworn enemy (you can have pizza together afterward). It's one-on-one in the Gladiator version of Battle. Once you are hit or manage to strike your nemesis, you both return to your side of the field marked with your team lights or base markers 14*a* or 14*b*. Go again until one individual is out due to two hits. The team with the most individual winners is victorious and true Gladiators!

Gladiators—Steal the Bacon Version

This speed focused version of Gladiators starts with one-on-one fights, minus an important item. You and your opponent are unarmed so you both race to your Weapons of Light or batons 22*a* or 22*b* in the middle of the field. Strike quickly and with laser accuracy as soon as you grasp your foam sword or baton 22*a* or 22*b*. The winner is determined in the same manner as traditional Gladiators. (Again, the countdown method starts this version of Gladiators)

Gladiators—Wound Variation

Now, this version is more detailed. If you are hit in the arm, you have only one arm left to use. The same goes for a leg hit. You must hop on your "remaining good" leg if you suffer a leg hit. Lose two legs and you are finished. Two arm hits and again, you are done. Two body hits will finish you off also. (Again, the countdown method starts this version of Gladiators) There are three ways to determine who you are pitted against: 1) King of the Hill—Win and stay in, Simple, The "King" plays a new opponent until the King is defeated; 2) Round Robin—Players rotate to play a new rival each round until all players have challenged each other, Two losses puts you out; and 3) Two-round Elimination—Winners from round one play each other in round two. The same goes for losers in round one. Lose twice and you are defeated. It is possible that two undefeated winners will be the last two Gladiators standing. One battle will determine the true champion between those two contestants.

Battle

Time to get crazy and see how bad you want a win. No more orderly chaos. Battle makes you start with no Weapon of Light or baton 22*a* or 22*b*. The swords or batons 22*a* or 22*b* are tossed randomly in the middle of the field. As the game starts all the players rush to the middle of the battlefield to try to grab your correct team color sword or baton 22*a* or 22*b* (unlit for added drama). If you grab the wrong color, feel free to giggle as you toss it away from your frantic opponents. You cannot hold onto an enemy weapon or baton 22*a* or 22*b* though. Once you have your weapon or baton 22*a* or 22*b*, you can foam-attack at will, even if your rival has no Weapon of Light or baton 22*a* or 22*b* yet! The game ends when one team has no one left to do Battle!

Kings & Queens

This is like chess. Picture one blue player and one green player as a ruler (King or Queen). Rulers have no weapon or baton 22*a* or 22*b* so they must be protected by the Knights with swords or batons 22*a* or 22*b*. Once a Ruler is whacked twice, that team is defeated. Protect your Ruler, while going for the opposing Ruler with all you got!

Thieves and Guards

You need a large field for this game type. The evenly divided teams have unarmed Thieves wearing lit wristbands or team identifiers 18*a* and 18*b*, and Guards with Weapons of Light or batons 22*a* or 22*b*. Thieves attempt to steal all four of the Guards' Station lights or base markers 14*a* or 14*b*. The 15 ft rule applies of course so guards can't camp close to the lights or base markers 14*a* or 14*b* until a Thief is within the 15 ft range of the light or base maker 14*a* or 14*b*. A Thief must hold any light or base marker 14*a* or 14*b* he steals for the entire game. A Thief suffering a hit must "Regenerate" to his last life by exiting the boundaries of the field. A Guard can't go beyond the boundaries, but Thieves may anytime. Teams switch roles once all Thieves have been defeated or all the lights or base markers 14*a* or 14*b* have been stolen from the Guards. The winner is the team who nabs the most lights or base markers 14*a* or 14*b* during their turn as Thieves.

Vampires

One player gets to be the big bad Vampire (a dangerous creature especially with a Weapon of Light) and tries to hit Villagers. Every hit turns the struck Villager into another Vampire. Once the ghastly transformation happens the Villager turns on his Weapon of Light or baton 22*a* or 22*b* (powered off until now) and begins hunting his former teammates. If you're a Villager, try to survive as long as you can. The last Villager to be hit by the Vampire and his growing coven will begin a new round as the new Vampire.

While many examples have been discussed with respect to playing a capture the flag game, it is to be understood that various types of games with a variety of rule variations can be utilized with examples and equivalents of those disclosed herein.

It is to be understood that the embodiments of the invention disclosed are not limited to the particular structures, process steps, or materials disclosed herein, but are extended to equivalents thereof as would be recognized by those ordinarily skilled in the relevant arts. It should also be understood that terminology employed herein is used for the purpose of describing particular embodiments only and is not intended to be limiting.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various embodiments and example of the present invention may be referred to herein along with alternatives for the various components thereof. It is understood that such embodiments, examples, and alternatives are not to be construed as de facto equivalents of one another, but are to be considered as separate and autonomous representations of the present invention.

Furthermore, the described features, structures, or characteristics may be combined in any suitable manner in one or more embodiments. In the description, numerous specific details are provided, such as examples of lengths, widths, shapes, etc., to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the foregoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

What is claimed is:

1. A method of establishing game play for a game with a kit of parts for playing a tag game in low-light conditions with at least first and second teams and multiple players on each team, comprising:

the kit of parts comprising:

at least one light emitting first base marker having a bottom surface configured to be disposed on a support surface, and providing light of a first color assigned to the first team;

at least one light emitting second base marker having a bottom surface configured to be disposed on the support surface, and providing light of a second color assigned to the second team;

a first plurality of light emitting team identifiers comprising an apparel wearable by players of the first team, each of the first plurality of team identifiers providing light of the first color to identify team affiliation for the players on the first team;

a second plurality of light emitting team identifiers comprising an apparel wearable by players of the second team, each of the first plurality of team identifiers providing light of the second color to identify team affiliation for the players on the second team;

a first plurality of light emitting, elongated batons carryable by players of the first team, each of the first plurality of batons comprising a handle and a compliant shank, each of the first plurality of batons providing light of the first color;

a second plurality of light emitting, elongated batons carryable by players of the second team, each of the second plurality of batons comprising a handle and a compliant shank, each of the second plurality of batons providing light of the second color;

the first color being associated with the first base marker, the first plurality of team identifiers and the first plurality of batons, with the first base marker, the first plurality of team identifiers and the first plurality of batons being capable of emitting light of the first color;

the second color being different than the first color and being associated with the second base marker, the second plurality of team identifiers and the second plurality of batons, with the second base marker, the second plurality of team identifiers and the second plurality of batons being capable of emitting light of the second color; and instructions instructing players to play at least one game with the first and second base markers, the first and second plurality of team identifiers, and the first and second plurality of batons;

the method comprising:

instructing the players to divide into the first and second teams;

instructing the players of the first and second teams to assign the first and second colors to the first and second teams, respectively;

instructing the players to deploy the first and second base markers on the support surface, and to cause the first and second base markers to emit light of the first and second colors, respectively;

instructing the players of the first and second teams to don the first and second plurality of team identifiers, respectively, and to cause the first and second plurality of team identifiers to emit light of the first and second colors, respectively;

instructing the players of the first and second teams to bear the first and second plurality of batons, respectively, and to cause the first and second plurality of batons to emit light of the first and second colors, respectively;

instructing the players of the first and second teams to wield the first and second plurality of batons, respectively, to strike the players of another team while avoiding being struck by a baton of another team;

instructing the players to return to the first or second base marker of their team when they are struck by the baton of another team; and instructing the players to return to play after being struck by a baton of another team and returning to the first or second base marker of their team.

2. The method in accordance with claim 1, further comprising:

instructing the players to change a mode of a team identifier when they are struck by the baton of another team.

3. A method of playing a game with a kit of parts the kit of parts comprising:

at least one light emitting first base marker having a bottom surface configured to be disposed on a support surface, and providing light of a first color assigned to the first team;

at least one light emitting second base marker having a bottom surface configured to be disposed on the support surface, and providing light of a second color assigned to the second team;

a first plurality of light emitting team identifiers comprising an apparel wearable by players of the first team, each of the first plurality of team identifiers providing light of the first color to identify team affiliation for the players on the first team;

a second plurality of light emitting team identifiers comprising an apparel wearable by players of the second team, each of the first plurality of team identifiers providing light of the second color to identify team affiliation for the players on the second team;

a first plurality of light emitting, elongated batons carryable by players of the first team, each of the first plurality of batons comprising a handle and a compliant shank, each of the first plurality of batons providing light of the first color;

a second plurality of light emitting, elongated batons carryable by players of the second team, each of the second plurality of batons comprising a handle and a compliant shank, each of the second plurality of batons providing light of the second color;

the first color being associated with the first base marker, the first plurality of team identifiers and the first plurality of batons, with the first base marker, the first plurality of team identifiers and the first plurality of batons being capable of emitting light of the first color;

the second color being different than the first color and being associated with the second base marker, the second plurality of team identifiers and the second plurality of batons, with the second base marker, the second plurality of team identifiers and the second plurality of batons being capable of emitting light of the second color; and instructions instructing players to play at least one game with the first and second base markers, the first and second plurality of team identifiers, and the first and second plurality of batons;

the method comprising:

dividing into the first and second teams;

assigning the first and second colors to the first and second teams, respectively;

deploying the first and second base markers on the support surface, and causing the first and second base markers to emit light of the first and second colors, respectively;

donning the first and second plurality of team identifiers, respectively, and causing the first and second plurality of team identifiers to emit light of the first and second colors, respectively;

bearing the first and second plurality of batons, respectively, and causing the first and second plurality of batons to emit light of the first and second colors, respectively;

wielding the first and second plurality of batons, respectively, to strike the players of another team and avoiding being struck by a baton of another team;

returning to the first or second base marker of an assigned team when struck by the baton of another team;

returning to play after being struck by a baton of another team and returning to the first or second base marker of the assigned team; and ceasing play when struck by the baton of another team after a predetermined number of times.

4. The method in accordance with claim 3, further comprising:

changing a mode of a team identifier when struck by the baton of another team; and returning to play after being struck by a baton of another team and returning to the first or second base marker of the assigned team and changing the mode of the team identifier.

5. A method of playing a game, comprising:

providing first and second light emitting base markers, each having a bottom surface configured to be disposed on a support surface, and each capable of providing light of first or second color, respectively;

providing first and second pluralities of light emitting team identifiers, each comprising an apparel wearable by players, and each capable of providing light of the first or second color, respectively;

providing first and second pluralities of light emitting, elongated batons carryable by players, each comprising a handle and a compliant shank, and each capable of providing light of the first or second color respectively;

dividing the players into first and second teams;

assign the first and second colors to the first and second teams, respectively, the first color being associated with the first base marker, the first plurality of team identifiers and the first plurality of batons, and the second color being associated with the second base marker, the second plurality of team identifiers and the second plurality of batons;

deploy the first and second base markers on the support surface, and causing the first and second base markers to emit light of the first and second colors, respectively;

donning the first and second plurality of team identifiers, respectively, and causing the first and second plurality of team identifiers to emit light of the first and second colors, respectively;

bearing the first and second plurality of batons, respectively, and causing the first and second plurality of batons to emit light of the first and second colors, respectively; and wielding the first and second plurality of batons to strike a player of another team while avoiding being struck by a baton of another team.

6. A method of claim 5, further comprising:

returning to the first or second base marker when struck by the baton of another team;

returning to play after being struck by a baton of another team and returning to the first or second base marker of their team; and ceasing play when struck by the baton of another team after a predetermined number of times.

7. A method of claim 5, further comprising:

changing a mode of the of a team identifier when struck by the baton of another team; and returning to play after being struck by a baton of another team and returning to the first or second base marker of their team and changing the mode of the team identifier.

* * * * *